United States Patent [19]

Hanson et al.

[11] 4,323,243

[45] Apr. 6, 1982

[54] ELECTRICAL BOARD GAME DEVICE

[75] Inventors: Steven P. Hanson, Rancho Palos Verdes, Calif.; Howard J. Morrison, Deerfield; Douglas P. Montague, Chicago, both of Ill.

[73] Assignee: Marvin Glass & Associates, Chicago, Ill.

[21] Appl. No.: 199,013

[22] Filed: Oct. 20, 1980

[51] Int. Cl.[3] ..... A63F 9/08

[52] U.S. Cl. ..... 273/153 S; 273/238; 434/341

[58] Field of Search ..... 273/153 S, 237, 238, 273/1 E; 434/340, 341

[56] References Cited

U.S. PATENT DOCUMENTS

| | | | |
|---|---|---|---|
| 1,101,567 | 6/1914 | Ridgway | 273/153 S |
| 3,697,076 | 10/1972 | Vogel | 273/238 |
| 4,150,828 | 4/1979 | Marchese | 273/260 |

FOREIGN PATENT DOCUMENTS

| | | | |
|---|---|---|---|
| 1286779 | 1/1962 | France | 273/238 |

OTHER PUBLICATIONS

"Giant Checkerboard", Science & Invention for Nov. 1925, p. 613.

*Primary Examiner*—Anton O. Oechsle

*Attorney, Agent, or Firm*—Mason, Kolehmainen, Rathburn & Wyss

[57] ABSTRACT

An electrical board game device is described in which a plurality of slidable elements are mounted on a housing for relative sliding movement with respect to each of the other elements on the housing. Each element has a uniquely arranged pattern of electrical contacts in circuit with a light emitting diode. A pair of matching contacts are arranged on the housing in a position to complete an electrical circuit with the contacts on the element when the element is appropriately positioned. The elements, which appear to the player to all be identical, are slid relative to each other in an attempt to correctly position each element atop its matching contacts on the housing so that the light emitting diode of each element is illuminated.

11 Claims, 6 Drawing Figures

ELECTRICAL BOARD GAME DEVICE

BACKGROUND OF THE INVENTION

1. Field of the Invention

This invention relates generally to board game devices and particularly to device in which a plurality of sliding elements must be positioned in predetermined locations by sliding the elements relative to each other.

2. Brief Description of the Prior Art

Board game devices which involve a plurality of rectangular elements retained in a frame for relative sliding movement relative to the frame and to each of the other elements to position the randomly arranged elements in the order determined by indicia on the outward face are well known. These games normally involve a plurality of numbered elements with one element missing to enable relative movement so that the elements can be slid around the game board until they are arranged in order of increasing numerical indicia.

In addition, electrically operated games with electrical means for indicating a selected board playing position are also well known. Indicative of such games are the following U.S. Pat. Nos.: 4,185,832, 4,006,903, 3,863,931, 3,844,567, 3,778,063 3,376,041, 3,367,663, 3,690,665, 3,194,560, 3,152,805 and 3,145,993.

SUMMARY OF THE INVENTION

An object of the present invention to provide a positioning game device with relatively slidable positioning elements that must be positioned in predetermined positions, but with no means discernible by the user until the elements are correctly positioned for distinguishing between those various elements.

These and other objects of the present invention are provided for by a game device including a housing having a plurality of spaced electrical contacts. A plurality of elements are mounted on the housing for sliding movement relative to the housing and the other elements. Each element has a distinct pattern of electrical contacts arranged to complete an electrical circuit with the contacts of the housing when and only when the element is positioned in a predetermined position on the housing. Indicating means are provided for indicating when the element has been positioned in its predetermined location on the housing.

BRIEF DESCRIPTION OF THE DRAWING

These and other objects of the present invention will become more apparent with reference to the following description taken in conjunction with the accompanying drawing, wherein.

DESCRIPTION OF THE PREFERRED EMBODIMENT

Figure 1:
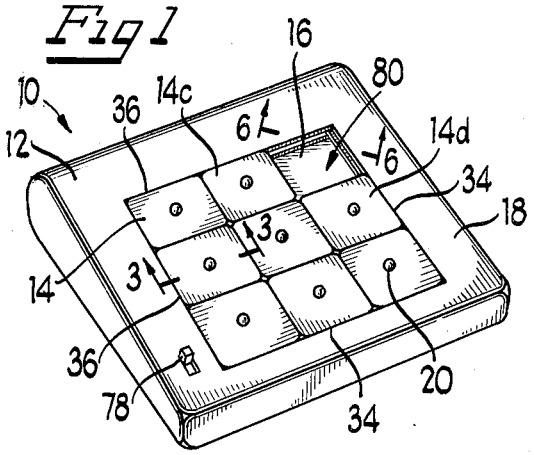
FIG. 1 is a perspective view of one embodiment of the present invention.

Referring to the drawing wherein like reference characters are used for like parts throughout, there is shown in FIG. 1 a board game device 10. The device 10 includes a housing 12 and a plurality of slidable elements 14, preferably rectangular in shape, arranged in an abutting matrix of transverse rows and columns for sliding movement within a recess 16, preferably rectangular in shape, in the upper surface 18 of housing 12.

Figure 3:
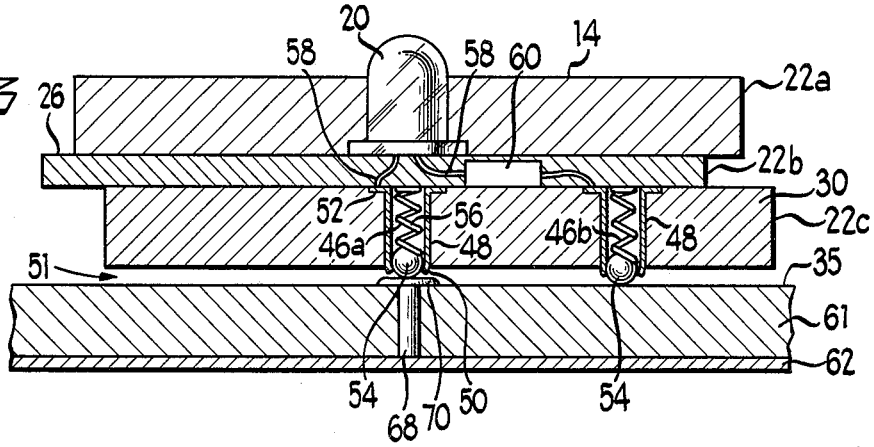
FIG. 3 is an enlarged partial cross-sectional view taken generally along the line 3—3 of FIG. 1.
Figure 5:
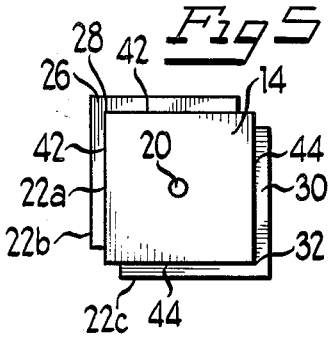
FIG. 5 is an enlarged plan view of one of the movable elements shown in FIG. 1.

As shown in FIGS. 3 and 5 each element 14 includes a centrally exposed light emitting diode 20 and three layers 22, with the diode 20 extending through upper layer **22*a*. The middle layer 22*b* and the lower layer 22*c* are offset from the upper layer 22*a* along a common diagonal of layer 22*a* so that an L-shaped portion 26 of layer 22*b* extends outwardly from under one corner 28 of top layer 22*a*, while an L-shaped portion 30 of layer 22*c* extends outwardly from under the opposite corner 32 of layer 22*a*. Preferably, the three layers 22 are secured together by suitable means, such as adhesive, or the like, but the layers 22 may also be formed integrally. For convenience, the layers 22** may each be of different thickness.

Figure 6:
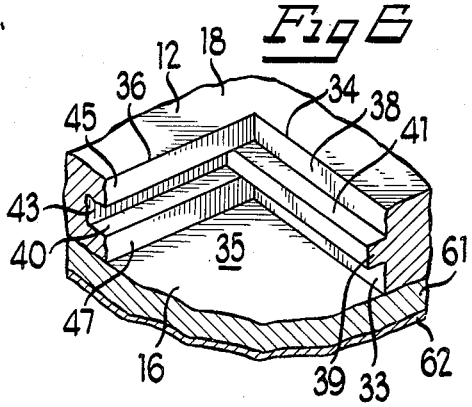
FIG. 6 is an enlarged cross-sectional view taken generally along the line 6—6 in FIG. 1.

The recess 16 includes two pairs of sides 34 and 36 extending inwardly of housing 12 from the upper surface 18 to a surface 35. As shown in FIG. 6, one pair of sides 34 includes an outwardly extending stepped land 38 designed to key into layers **22*a* and 22*b*. The land 38 includes a protruding tab 39 and a stepped surface 41. The layer 22*a* contacts the surface 41 of one or more elements 14 arranged along side 34 while tab 39 contacts the layer 22*b*. The L-shaped portion 30 of lower layer 22*c* slides within slot 33 beneath tab 39. The opposite sides 36 possess an inwardly directed notch 40, complementarily shaped to land 38, designed to receive the L-shaped portion 26 of layer 22*b* within its slot 43 and layer 22*a* against its surface 45, while layer 22*c* slides along edge 47. Each element 14 includes two contiguous sides 42 designed to mate with sides 36 of recess 16 and two sides 44 designed to mate with sides 34 of recess 16. Thus, sides 42 of one element 14 are also designed to mate with sides 44 of any other element 14**.

As shown in FIG. 3, each element 14 also includes a pair of spaced spring mounted contacts 46. Each contact 46 includes a tubular metal housing 48 extending through layer **22*c* having an inwardly flared lower end 50 and an outwardly flanged upper end 52. A metal ball 54 is retained within the tubular housing 48, extending outwardly from layer 22*c* into a gap 51 formed between element 14 and surface 35, retained by the inwardly flared lower end 50 and a spring 56 compressed within housing 48 between the ball 54 and the layer 22*b*. A pair of wires 58 extend through layer 22*b* to electrically connect the outwardly flanged upper end 52 of housing 48 to one terminal of the diode 20, and to connect the other terminal of diode 20 to the other contact 46*b* through a resistor 60**.

Figure 4:
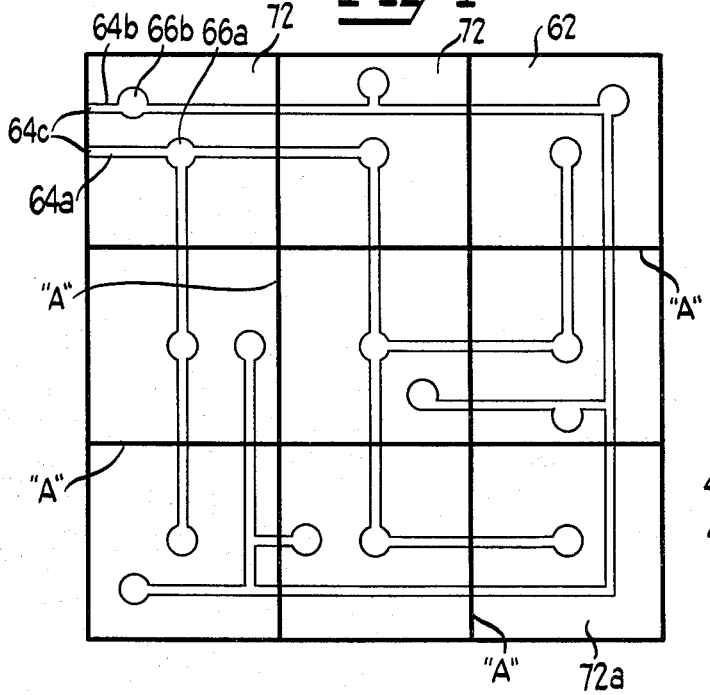
FIG. 4 is an enlarged plan view of the printed circuit board shown in FIG. 2.

Beneath the layer 61 that forms the lower surface 35 of recess 16 is a printed circuit board 62 having on its upper surface a pattern of conducting deposits 64 as shown in FIG. 4 made up of two portions **64*a* and 64*b*, connected to a source of electrical potential at ends 64*c*. A plurality of metal pins 68 each having a raised flange 70 protruding atop surface 35 extend through the layer 61 to make electrical contact with the conducting deposits 64 at each widened area 66**.

A matrix of element 14 positions 72 having the same area as layer 22*a* are defined by transversely intersecting lines "A" in FIG. 4, each position 72 except position 72*a* including two widened areas 66. A widened area 66*a* is positioned centrally on each element position 72, in order to contact the central contact 46*a* of each element 14. Each widened area 66*b* is positioned at a unique spatial orientation with respect to its associated central widened area 66*a* to make possible the completion of a circuit through a contact 46*b* also located at the same unique spatial orientation with respect to its central contact 46*a*. Preferably the areas 66*b* and contacts 46*b* are all positioned the same distance from their associated central area 66*a* or contact 46*a* but are located at distinct angular displacements conveniently about 45°, from their associated central areas 66*a* or contacts 46*a*. When a contact 46 is positioned over a pin 68, its ball 54 is moved upwardly into housing 48 against the bias of spring 56 by the raised flange 70 of the pin 68 but is retained in firm contact with the flange 70 by the spring 56.

Figure 2:
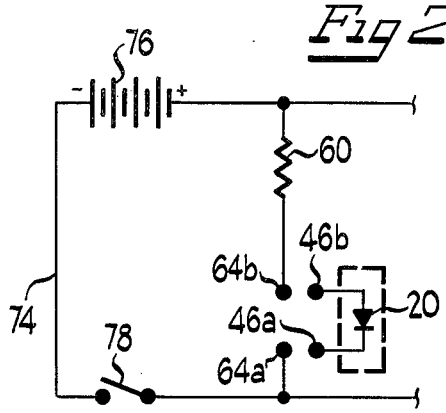
FIG. 2 is a partial circuit schematic for the embodiment shown in FIG. 1.

As shown in FIG. 2, contacts 46 on elements 14 when in contact with pins 68 serve to complete a circuit 74 including a power source 76 and and on-off switch 78. A closed circuit results from the connection of conducting portions 64*a* and 64*b* by appropriately positioned elements 14 through contacts 46 and diodes 20. Thus each diode 20 is connected in parallel with the other diodes 20 between portions 64*a* and 64*b*.

Even when all the elements 14 are positioned in recess 16 an extra unoccupied element position 72 remains, as indicated at 80 in FIG. 1, to provide the space to enable the elements 14 to be slid with respect to each other. Thus, when the elements 14 are positioned in their predetermined arrangement causing diodes 20 to be illuminated the inoperative position 72*a* is unoccupied. The position 72*a* still possesses one pin 68 and flange 70 so that a player is not able to feel a difference when an element 14 is moved onto position 72*a*.

The device 10 is played as follows. The slidable elements 14 are randomly ordered atop the lower surface 35 of recess 16. The device is turned on by actuating on-off switch 78. Each element 14 is then slid up and down or across the recess 16 by moving an element such as element 14*c* or 14*d* into the open space 80 creating a new open space 80 into which another element is moved subsequently. In this way, the elements 14 can be shifted to any position 72 on surface 35. When a light emitting diode 20 associated with an element 14 is illuminated the contacts 46 are aligned above similarly positioned pins 68 and the element 14 is correctly positioned. When all of the diodes 20 are illuminated, the player has completed the game. Although the player may be able to see the arrangement of the pins 68 by inspecting the open space 80, the player will be unable to determine which of the elements 14 match that respective pattern of pin 68 since the player cannot discern the arrangement of contacts 46 on the underside of the elements 14.

Each element 14 can be slid to any of the positions 72 shown in FIG. 4 since L-shaped portions 26 and 30 are arranged to mate with the sides 36 and 34 of recess 16 and the sides 44 and 42 of any other element 14. Since the elements 14 are translatable but not rotatable, the preset orientation of corners 28 and 32 cannot be varied.

In every element position 72, the central contact 46*a* of each element 14 is capable of electrical contact with a centrally positioned pin 68 in lower surface 35. However, only when in one predetermined, correct position does the contact 46*b* make electrical contact with a pin 68 positioned directly beneath it to complete the circuit causing a diode 20 to be illuminated.

Since all the elements 14 have an identical appearance as seen by the player, the game presents a considerable challenge despite its simple appearance. Success requires a good memory since even after one element 14 is correctly positioned it may be necessary to relocate it in order to move other elements 14 to their correct positions.

The foregoing detailed description has been given for clearness of understanding only and no unnecessary limitations should be understood therefrom. Many modifications and variations will be obvious to those skilled in the art. Thus it is to be understood that, within the scope of the appended claims, the invention may be practiced otherwise than as specifically described above.

What is claimed is:

1. A game device, comprising:

a housing including an electrical circuit having a plurality of spaced electrical contacts and a source of electrical potential;

a plurality of elements each retained on said housing for sliding movement relative to said housing and to the other of said elements, each element including a uniquely located electrical contact pair arranged to complete said electrical circuit when placed in a predetermined position on said housing;

recess means for retaining said elements for sliding movement along said playing surface, including space to permit said elements to be slid with respect to each other to position each element in a position formerly occupied by another of said elements;

means for locking said elements within said recess means for sliding movement within said recess means; and indicating means responsive to the completion of said electrical circuit for indicating when each said element has been positioned in said predetermined position on said housing.

2. The game device of claim 1 said elements and said recess means having mating tabs and grooves to permit movement of said elements relative to one another and said game board, in a fixed orientation.

3. A board game device comprising:

a housing having a playing surface with an electrical circuit including a plurality of separated electrical contact pairs located at spaced positions across said playing surface, a source of potential being connectable across said contact pairs;

a plurality of elements retained on said playing surface on said housing in an abutting matrix for sliding movement relative to said housing and to each other along said surface in only two perpendicular paths, each element including an actuator means uniquely arranged on said element for changing the state of conduction across a contact pair when the element is located in a predetermined position on the playing surface; and indicating means responsive to the changed state of conduction for indicating when each said element has been located in said predetermined position on said playing surface.

4. The game device of claim 3 wherein said indicating means is a light emitting diode.

5. The device of claim 3 wherein said housing includes recess means for slidably retaining said elements, said means including an open space to permit said elements to be slid with respect to each other to position each element in a position formerly occupied by another of said elements.

6. The device of claim 5 including means for locking said elements within said recess means for sliding movement within said recess means.

7. The device of claim 6 wherein said elements are rectangular and abut one another for side by side relative sliding movement.

8. The device of claim 7, said elements and said recess means having mating tabs and grooves to permit movement of said elements in a fixed orientation relative to one another and said playing surface.

9. The device of claim 6 wherein the distance between opposite sides of said recess means is equal to the combined length of the elements in the direction parallel to said sides of said recess means.

10. The device of claim 3 wherein said contact pairs are connected in parallel in said electrical circuit.

11. The device of claim 3 wherein each of said elements have an identical outward appearance.

* * * * *